US007059312B2

(12) United States Patent
Olzinger et al.

(10) Patent No.: US 7,059,312 B2
(45) Date of Patent: Jun. 13, 2006

(54) ELECTRIC IGNITION UNIT FOR IGNITING PROPELLANTS

(75) Inventors: Adolf Olzinger, Ergolding (DE); Richard Bender, Lauf (DE)

(73) Assignee: Schott AG, Mainz (DE)

( * ) Notice: Subject to any disclaimer, the term of this patent is extended or adjusted under 35 U.S.C. 154(b) by 200 days.

(21) Appl. No.: 10/842,262

(22) Filed: May 10, 2004

(65) Prior Publication Data

US 2005/0016510 A1 Jan. 27, 2005

(30) Foreign Application Priority Data

May 10, 2003 (DE) ..... 103 21 067

(51) Int. Cl.
*F42B 3/00* (2006.01)
*F02P 15/00* (2006.01)

(52) U.S. Cl. ..... 123/634; 123/635; 123/143 B

(58) Field of Classification Search ..... 123/594, 123/634, 635, 143 B; 102/200, 202, 202.2, 102/202.3, 202.5, 202.7, 202.8, 202.9
See application file for complete search history.

(56) References Cited

U.S. PATENT DOCUMENTS 5,027,707 A * 7/1991 Mei ..... 102/202.8
5,153,368 A * 10/1992 Fogle, Jr. ..... 102/202.2
5,686,691 A * 11/1997 Hamilton et al. ..... 102/202.5
5,944,545 A * 8/1999 Willhelm et al. ..... 439/188
6,274,252 B1 8/2001 Naugler et al.

FOREIGN PATENT DOCUMENTS

| | | |
|---|---|---|
| DE | 2633590 | 2/1978 |
| DE | 3446799 | 7/1986 |
| DE | 3920402 | 1/1991 |
| DE | 4140692 | 6/1993 |
| DE | 19925386 | 12/1999 |

* cited by examiner

*Primary Examiner*—Hai Huynh
(74) *Attorney, Agent, or Firm*—Randall J. Knuth

(57) ABSTRACT

An ignition unit for igniting propellants having at least one electrically conductive pin with a pin holder comprising a metal ring which encloses the pin by leaving an annular cavity with an insulating filing in the annular cavity. An electrically conductive bridge or a semi-conductor bridge connects between the metal ring and the pin with a sealing cap which is connected to the one face side of the pin holder and which receives the propellant. A plug can be connected in a positive or non-positive way with the metal ring on its end averted from the sealing cap and which enters into an electrically conductive connection with the pin in operation. At least one of the two elements, either the metal ring or the plug are provided with a coating in the region between the mutual connection, which coating has a low electric contact resistance between the plug and the metal ring.

11 Claims, 1 Drawing Sheet

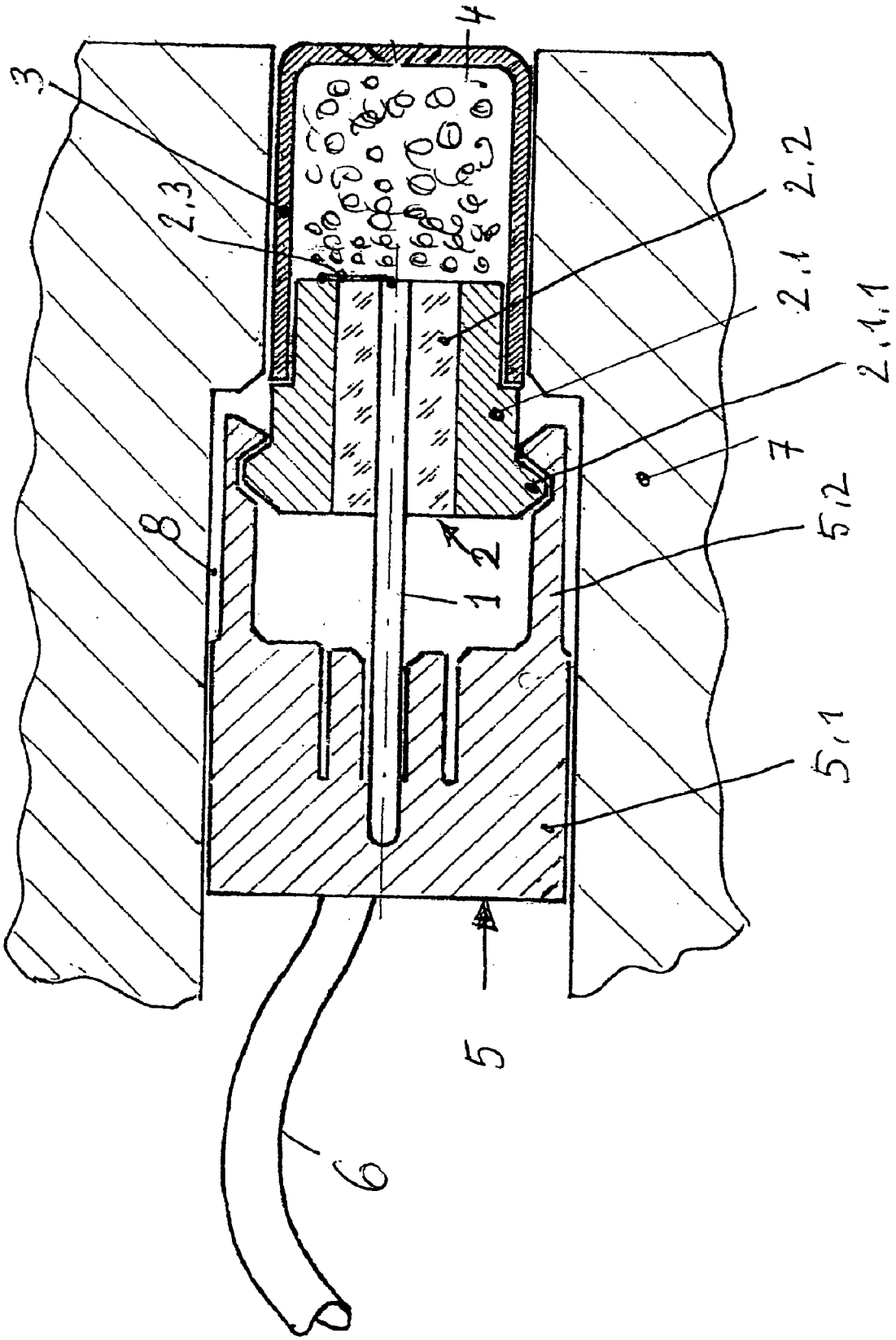
4
3
2.3
2.2
2.1
2.1.1
7
5.2
8
1
2
5.1
5
6

ELECTRIC IGNITION UNIT FOR IGNITING PROPELLANTS

BACKGROUND OF THE INVENTION

1. Field of the Invention

The present invention relates to an electric ignition unit for igniting propellants. The propellants can be solid, liquid or gaseous. The important components of such an ignition unit are at least a pin made of an electrically conductive material, a pin holder comprising a metal ring which is overdimensioned relative to the pin and thus encloses an annular space with the same, as well as an electrically insulating filling in the annular space. At the one end of the pin holder there is a sealing cap for receiving the propellant (igniting agent). At the other end of the pin holder there is a plug which is connected with the pin holder in a random manner and immerses into the pin during operation in a contacting fashion and thus produces an electrically conductive connection. The entire apparatus is situated in a housing.

The filling of the pin holder generally consists of an insulating material, e.g. of glass. Such a material is molten in the metal in a vacuum-tight manner.

2. Description of the Related Art

Such ignition units are widely used in electronics and electrical engineering. The glass used for melting is used in this case as an insulator. Typical glass-to-metal seals are configured as follows: metallic internal conductors are molten into a preformed sintered glass element, with the sintered glass element being molten into an outer metal part.

The said ignition units are used for airbags or seat-belt tightening systems in motor vehicles. The entire ignition unit with the pin holder configured as a glass-to-metal seal comprises an ignition bridge. The glass-to-metal seal plays an important role. It is necessary in order to supply to a housing in a reliable and insulated manner the electrical voltage which occurs through one or two metallic pins.

Known glass-to-metal seals are configured as follows: a glazed or insulated pin and an additional conductor as a ground wire are used; the ground wire is usually welded or soldered. It thus produces the necessary connection to the metallic housing. This embodiment is very complex and expensive to produce. A serious disadvantage is that the ground connection to the external housing is relatively insecure. This can have serious consequences, especially in the case of the mentioned applications of the airbag and the seat-belt tightening system.

Known ignition units of the aforementioned or similar kind have been described in U.S. Pat. No. 6,274,252, U.S. Pat. No. 5,621,183, DE 29 04174 A1 or DE 19927233 A1.

All the said ignition units comprise two metal pins. The present invention deals especially with electric ignition units which have only one pin.

Serious problems of the aforementioned ignition units are the following:

The transitions between the conductive parts have a resistance which is relatively high. A further disadvantage of known ignition units is the service life. This is unsatisfactory in known ignition units. This is caused at least in part by corrosion of the involved components.

SUMMARY OF THE INVENTION

The invention is based on the object of providing an ignition unit which avoids the said disadvantages. The service life is to be increased in comparison with known ignition units. The total resistance of the supply conductors and the transitions to the electrically conductive components is to be low, if possible lower than 0.5 Ω. The required ignition power is to be reduced in comparison with known ignition units to values below 1000 μJ.

A total resistance of the supply conductors and the electric transitions of below 0.1 Ω can be achieved. A service life of 15 years and more is reached. The ignition power is below 1000 μJ, namely 500 to 400 μJ. The resistances at the transition points remain constant over many years, so that the operational behavior is very consistent over years. The ignition unit with all its elements is highly resistant to corrosion.

Another important advantage is that the plug on the one hand and the pin holder on the other hand can be mounted very easily, reliably and exactly, without requiring any cumbersome and time-consuming manipulations by the fitter.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein:

FIG. 1 shows an axial sectional view of an ignition unit in built into a housing.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

As can be seen, the ignition unit comprises a single metal pin 1. It is carried by a pin holder 2. The pin holder 2 substantially consists of a metal ring 2.1. The metal ring 2.1 encloses the pin 1 by leaving an annular cavity. The annular cavity comprises a glass filling 2.2. The glass filling generally fills the said cavity in a full and complete way. This is not mandatory, however. The filling can, as mentioned above, also consist of other insulating materials such as plastic material or ceramics.

The pin holder 2 is substantially of a cylindrical shape.

Pin 1 and metal ring 2.1 are mutually connected through an electrically conductive bridge 2.3. It is also possible to use a semi-conductor bridge.

A sealing cap 3 is connected to the one face side of the pin holder 2. It contains a propellant 4 (igniting agent). As can be seen, the metal ring 2.1 comprises a nose onto which the free end of the sealing cap 3 is slid. The connection between the metal ring 2.1 and the sealing cap 3 is configured as a sliding or clamping seat, so that the sealing cap 3 is rigidly connected with the metal ring 2.1 without any further fixing by a certain tension. The sealing cap is usually welded together with the metal ring.

A further important component is the plug 5. It is also of approximately cylindrical shape in the present case. The longitudinal axes of pin holder 2 and plug 5 are in alignment with each other.

The metal ring 2.1 comprises a circular collar 2.1.1. Plug 5 is composed of a basic body 5.1 and a sleeve 5.2. The sleeve 5.2 comprises a recess at its free end which is also circular and whose shape corresponds substantially to that of collar 2.1.1. The two elements of metal ring 2.1 and plug 5 are mutually connected in the manner of a snap-in connection as a result of the circular collar 2.1.1 and the recess.

Instead of the mentioned sleeve which per se has a closed circular cross section, it is also possible that several legs are connected with the basic body 5.1, e.g. evenly distributed over the circumference of the basic plug 5.

A plug-in connection could be provided in this case instead of the snap-in connection which is shown here. In this case the plug again comprises a basic body as well as a sleeve and the metal ring 2.1 comprises a respective recess for introducing the free end of the sleeve. The dimensions of the free end of the sleeve and the recess in the metal ring can be dimensioned in such a way that a wedging between the metal ring 2.1 and the plug 5 is produced.

As is shown, metal pin 1 projects beyond the face side of pin holder 2 which is opposite of the sealing cap 3. The free end of the metal pin 1 is introduced into a bore or is in a plug sleeve in the basic body 5.1 of the plug. The jacket surface of the plug 1 lies flush in the said bore or in the plug sleeve and produces a favorable electric conductive connection between these two parts.

The decisive aspect is that a coating is situated in the region of the connection between the metal ring 2.1 and the plug 5, which coating ensures a very low electric contact resistance between the two elements of plug and metal ring. This resistance lies below 0.1 Ω, e.g. 0.05 Ω.

Especially gold will be considered as a coating material. Other noble metals can also be used.

The coating can either be applied to the collar 2.1.1 of the metal ring 2.1 or on the recess of the sleeve 5.2 of plug 5 or, if a sleeve is not concerned, on respective recesses of webs which are components of the plug 5. The coating can be applied to both elements, thus on the metal ring and at the same time on the plug.

Plug 5 is connected to an electric conductor 6.

The entire unit is situated on a housing 7. As can be seen, an annular cavity 8 is situated between the housing 7 and the sleeve 5.2 of plug 5. It allows an elastic straddling of the sleeve 5.2 when it is clipped onto collar 2.1.1.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An electric ignition unit for igniting propellants comprising:

at least one electrically conductive pin (1);

a pin holder (2) having a metal ring (2.1) which encloses said pin (1) creating an annular cavity;

an insulating filling (2.2) in the annular cavity;

at least one of an electrically conductive or semiconductor bridge (2.3) between said metal ring (2.1) and said pin (1);

a sealing cap (3) which is connected to the one face side of said pin holder (2) and which receives the propellant;

a plug (5) which can be connected in a positive or non-positive way with said metal ring (2.1) on its end averted from said sealing cap (3) and which enters into an electrically conductive connection with said pin (1) in operation with at least one of either said metal ring (2.1) or said plug (5), being provided with a coating in the region between the mutual connection, which coating has a low electric contact resistance between said plug (5) and said metal ring (2.1);

the electric contact resistance between plug (5) and the metal ring (2.1) being smaller than 0.5 Ω; and at least the end of said plug (5) close to the metal ring (2.1) being arranged as a sleeve (5.2), grasping the end of said metal ring (2.1) which is close to it with said sleeve (5.2) and said metal ring (2.1) forming a snap-in connection with each other.

2. An electric ignition unit as claimed in claim 1, in which said filling between pin (1) and metal ring (2.1) consists of at least one of glass or ceramic material or plastic or any other insulating material.

3. An electric ignition unit as claimed in claim 2, characterized in that said sealing cap (3) is pushed onto the end of said metal ring (2.1) which is averted from said plug (5) and forms a tight seal with said end.

4. An electric ignition unit as claimed in claim 2 in which said pin holder (2), said plug (5) and said sealing cap have a substantially circular-cylindrical shape and their longitudinal axes are in alignment with each other.

5. An electric ignition unit as claimed in claim 2 in which said sealing cap (3) and said metal ring (2.1) are welded to each other.

6. An electric ignition unit as claimed in claim 1, characterized in that said sealing cap (3) is pushed onto the end of said metal ring (2.1) which is averted from said plug (5) and forms a tight seal with said end.

7. An electric ignition unit as claimed in claim 6 in which said pin holder (2), said plug (5) and said sealing cap have a substantially circular-cylindrical shape and their longitudinal axes are in alignment with each other.

8. An electric ignition unit as claimed in claim 6 in which said sealing cap (3) and said metal ring (2.1) are welded to each other.

9. An electric ignition unit as claimed in claim 1 in which said pin holder (2), said plug (5) and said sealing cap have a substantially circular-cylindrical shape and their longitudinal axes are in alignment with each other.

10. An electric ignition unit as claimed in claim 9 in which said sealing cap (3) and said metal ring (2.1) are welded to each other.

11. An electric ignition unit as claimed in claim 1 in which said sealing cap (3) and said metal ring (2.1) are welded to each other.

* * * * *